United States Patent [19]

Herzfeld

[11] 4,406,453

[45] Sep. 27, 1983

[54] PORTABLE EXERCISER

[76] Inventor: Victor A. Herzfeld, 9250 Brookshire Ave., #204, Downey, Calif. 90240

[21] Appl. No.: 205,267

[22] Filed: Nov. 10, 1980

[51] Int. Cl.[3] ..... A63B 21/02

[52] U.S. Cl. ..... 272/137; 272/143

[58] Field of Search ..... 272/137, 142, 141, 143, 272/135

[56] References Cited

U.S. PATENT DOCUMENTS 3,761,083 9/1973 Buchner ..... 272/137

*Primary Examiner*—William H. Grieb
*Assistant Examiner*—William R. Browne
*Attorney, Agent, or Firm*—Ronald L. Juniper

[57] ABSTRACT

A portable machine for exercising the limbs and body muscles including a frame having a spaced pair of parallel rods joined together at opposite ends. Hand-holds extending between these rods are provided on one end and in the middle of the exerciser frame. The middle hand-hold is slidably mounted against spring-tensioning to provide exercising activity for a user.

4 Claims, 6 Drawing Figures

FIG. 1
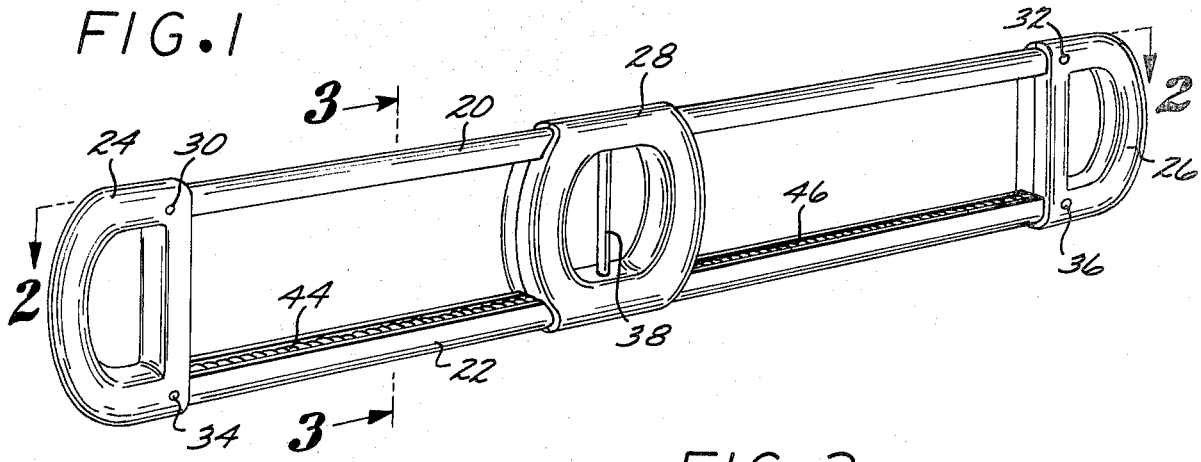
FIG. 2
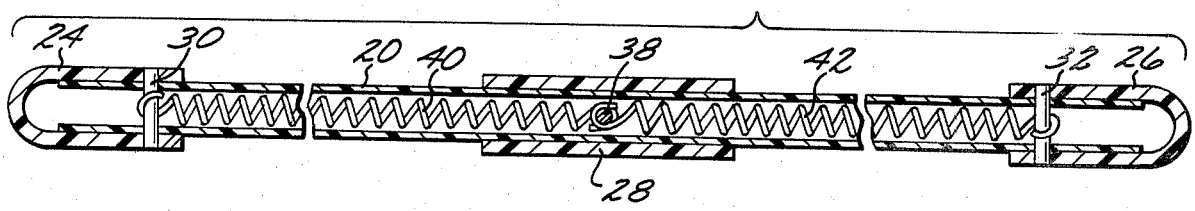
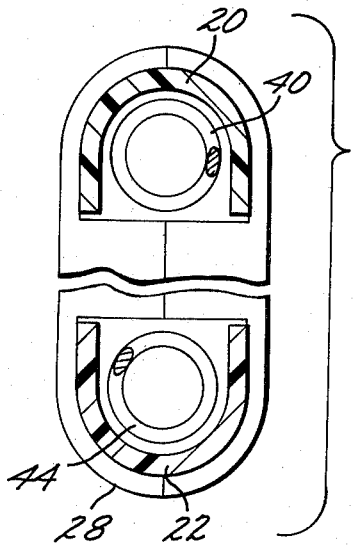
FIG. 3
FIG. 5
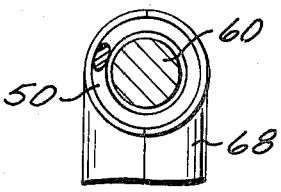
FIG. 6
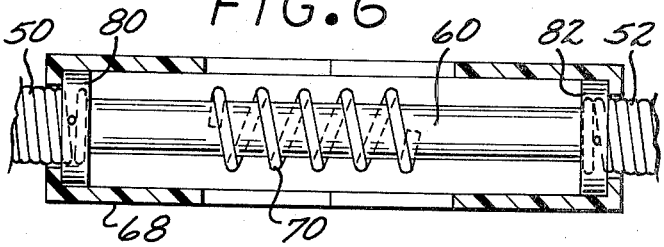
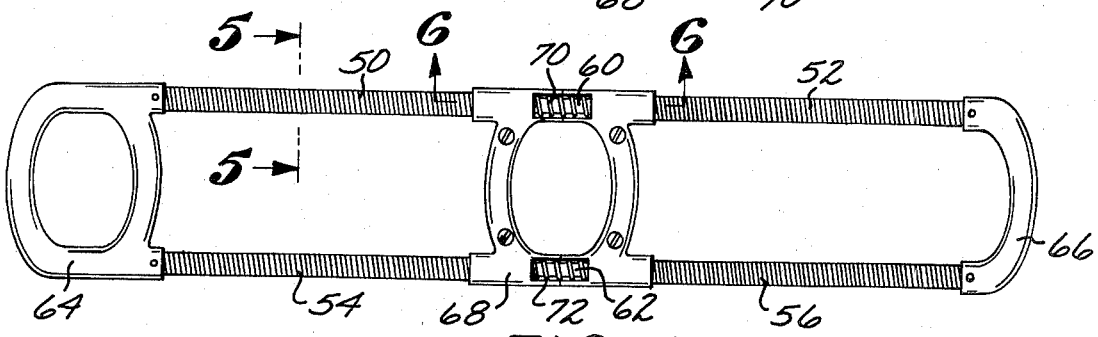
FIG. 4

PORTABLE EXERCISER

BACKGROUND OF THE INVENTION

Existing portable-type hand-held exercising apparatus have not been found suitable for exercising all of the muscles of the legs, upper arms and torso in desired manner. Thus, it was necessary to create this invention to provide means for proper exercise of normally unstressed muscles.

SUMMARY

In this exerciser invention a tubular framework is provided with springs which resiliently engage a slidable middle hand-hold, another hand-hold on one end and the remote opposite end of the apparatus.

Because of the particular placement of a hand-hold in the middle, unique resiliently loaded exercising stress can be created both by pulling and pushing when grasping the spring-tensioned handles.

BRIEF DESCRIPTION OF THE DRAWINGS

FIG. 1 is an isometric view of a sample form of this invention showing the exerciser with springs mounted internally within a pair of parallel rods connected by end hand-holds and a slidably mounted middle hand-hold.

FIG. 2 is a longitudinally sectional view taken through plane 2—2 in FIG. 1 showing internal spring connections.

FIG. 3 is a cross-sectional view taken through plane 3—3 in FIG. 1.

FIG. 4 is an elevational view of a preferred form of exerciser in which the springs are mounted outside of the tubular frame.

FIG. 5 is a cross-sectional view taken through 5—5 in FIG. 4.

FIG. 6 is a fragmented, longitudinally sectioned view of the middle handle showing a rod passing therethrough and springs positioned thereon.

DETAILED DESCRIPTION OF EMBODIMENTS OF THE INVENTION

Referring to the sample general form shown in FIGS. 1,2 and 3 an exerciser in accordance with this invention includes matched elongated straight tubular rods 20 and 22 mounted parallel with each other and held together at their opposite ends by means of end caps 24 and 26, respectively. Only one of these end caps serves as a hand-hold during use. A middle handle 28 is slidably mounted in the center area over both of rods 20 and 22. It serves as the other hand-hold during normal use.

The opposite ends of rod 20 are connected to an upper portion of end cap 24 by a pin 30 and to an upper portion of end cap 26 by pin 32. In a like manner the opposite ends of rod 22 are connected to a lower portion of end cap 24 by a pin 34 and to a lower portion of end cap 26 by a pin 36. Protruding into and between rod 20 and rod 22 are the opposite ends of a long pin 38 which extends through suitable openings in middle handle 28.

Extending within rod 20, each connected at one end to pin 38 and on the other end to pin 30 or pin 32 are, respectively, springs 40 and 42. In a like manner, extending within parallel rod 22, each connected at one end to pin 38 therein, and on the other end to pin 34 or pin 36, are respectively, springs 44 and 46. Thus, as middle hand-hold 28 is slidably moved on rods 20 and 22 it resiliently pulls against one set of springs.

Referring now to the preferred specific form of this invention shown in FIGS. 4, 5 and 6 the tension springs 50, 52 and 54, 56 are mounted on the outside of and around elongated, parallel rod members 60 and 62, respectively. Basically U-shaped end handle 64 and end element 66 on the other end provide suitably spaced connectors for rod members 60 and 62 so as to provide the exterior framework for the device and attachment means for the adjacent ends of the springs.

Rod members 60 and 62 are slidably mounted through a pair of spaced mating holes cut into the opposite sides of a middle handle 68 which is mounted thereon. Serving as resilient bumpers are short compression springs 70 and 72 slidably mounted on rods 60 and 62, respectively, within middle handle 68.

Springs 50, 52 on rod 60 and 54, 56 on rod 62 are spaced, respectively, from each other on the opposite ends of middle handle 68. The inner ends of these springs are each attached to rings, such as 80 and 82 shown in FIG. 6, which are slidably mounted on the portions of the rods which are within the middle handle. Only one pair of rings and attached springs at the same time are actively engaged with the movement of the middle handle since the rings are larger than the interior of the openings in the middle handle through which the springs pass so as to bear against the middle handle only when pulled.

Thus, in operation, when the middle handle 68 is gripped and pushed away from the end handle 64 springs 50 and 54 are resiliently pulled by engagement with the middle handle 68 which, in turn, slides over springs 52 and 56. Conversely, when middle handle 68 is pulled toward end handle 64 springs 52 and 56 are resiliently pulled by middle handle 68 which then slides over springs 50 and 54.

An example of an operative form of this invention is made of $\frac{7}{8}$ inch metal tubing for the frame members which are 32 inches long and 38 inches in overall length with the end members attached. These tubes are spaced about six inches apart and the middle handle is about ten inches long. The size and spacing allows for suitable gripping of the various parts of the hand-holds to perform a variety of exercises.

Though particular preferred forms of this invention are shown and described in the foregoing specification this is meant as exemplicative of the invention only and not a limitation, since the development is intended to comprehend all forms and modifications within the spirit of the following claims.

What is claimed is:

1. A portable exerciser comprising: a frame having a first end and a second end remote from each other; an end hand-hold rigidly formed on said first end of said frame; a middle hand-hold slidably mounted on an intermediate portion of said frame; a first pair of springs mounted on said frame between said end hand-hold and middle hand-hold and bearing against both said hand-holds; a second pair of springs mounted on said frame and bearing against said middle hand-hold and said second end portion of said frame, wherein said frame includes a pair of parallel tubular members, each having a portion extending through said middle hand-holds, said first pair of springs guided by said tubular members between said end hand-hold and said middle hand-hold and said second pair of springs guided by said tubular members between said middle hand-hold and said second end; and said first and second pair of springs each slidably secured to said tubular members so as to leave a space open between them on said portion of said tubular members within said middle hand-hold and resilient shock means positioned to receive impacts of said hand-hold when moved during use mounted on said spaces on said tubular members.

2. A portable exerciser as defined in claim 1 wherein said springs are tension type and said shock means are compression springs.

3. A portable exerciser as defined in claim 1 wherein attachments are provided for said springs which engage said middle hand-hold only when said springs are pulled.

4. A portable exerciser, as defined in claim 1, wherein said first and second pair of exercise springs are each secured to said tubular members so as to leave a space open between them on said portion of said tubular members within said middle handle and resilient shock means, positioned to receive impacts of said middle handle when moved during use, are mounted in said spaces on said tubular members.

* * * * *